US006843473B2

(12) United States Patent
Bohn et al.

(10) Patent No.: US 6,843,473 B2
(45) Date of Patent: Jan. 18, 2005

(54) APPARATUS FOR MANUFACTURING BOOK COVERS

(75) Inventors: Volker Bohn, Osnabrück (DE); Günter Geldmeier, Stemwede-Oppendorf (DE); Frank Tautz, Rahden (DE)

(73) Assignee: Kolbus GmbH & Co. KG, Rahden (DE)

( * ) Notice: Subject to any disclaimer, the term of this patent is extended or adjusted under 35 U.S.C. 154(b) by 426 days.

(21) Appl. No.: 09/989,235

(22) Filed: Nov. 19, 2001

(65) Prior Publication Data

US 2002/0061239 A1 May 23, 2002

(30) Foreign Application Priority Data

Nov. 21, 2000 (DE) ..... 100 57 599

(51) Int. Cl.[7] ..... B42C 7/00

(52) U.S. Cl. ..... 270/52.18; 412/19; 412/23; 281/29

(58) Field of Search ..... 270/52.18, 52.01, 270/58.01, 58.05, 58.23; 412/1, 5, 19, 23, 3, 17; 281/29

(56) References Cited

U.S. PATENT DOCUMENTS 2,922,172 A * 1/1960 Boyle ..... 156/516
2,970,634 A * 2/1961 Hantscho ..... 156/202
3,195,924 A * 7/1965 Carter et al. ..... 281/29
3,206,349 A * 9/1965 Boyle ..... 156/517
4,863,331 A * 9/1989 Torti ..... 412/3
5,127,786 A * 7/1992 Cross ..... 412/3
5,364,215 A * 11/1994 Snellman et al. ..... 412/3
5,409,341 A * 4/1995 Rathert ..... 412/17
5,413,446 A * 5/1995 Rathert et al. ..... 412/17
6,379,094 B1 * 4/2002 Porat ..... 412/9
6,669,429 B2 * 12/2003 Beermann et al. ..... 412/19

FOREIGN PATENT DOCUMENTS

DE 22 26 446 A 12/1972
DE 42 13 220 A1 10/1993
DE 43 08 469 A1 6/1994

OTHER PUBLICATIONS

German Search Report dated Nov. 13, 2001.

* cited by examiner

*Primary Examiner*—Patrick Mackey
(74) *Attorney, Agent, or Firm*—Alix, Yale & Ristas, LLP

(57) ABSTRACT

An apparatus for manufacturing book covers having a board feed for supplying cover boards and a spine insert having a covering material feed for supplying covering material, having a covering material cylinder, by means of which the supplied covering material is taken over, conveyed past a glue spreading roller and assembled with the supplied cover boards and having a folding and pressing apparatus as well as having a delivery apparatus and having a drive apparatus for the covering material feed, the board feed the covering material cylinder and the folding and pressing apparatus it is provided that at least the covering material feed the board feed and the folding and pressing apparatus are drivable in each case independently of one another. The covering material cylinder is preferably also provided with an independent drive. The independent drives are preferably servomotors, which are designed in each case as a slave and follow a virtual master The essential advantages of said apparatus are product-protecting and efficient fault handling as well as simple setting-up and correction operations.

16 Claims, 2 Drawing Sheets

APPARATUS FOR MANUFACTURING BOOK COVERS

BACKGROUND OF THE INVENTION

The invention relates to an apparatus for manufacturing book covers.

Apparatuses of said type are known as book cover machines based on a horizontal processing principle, in which in a continuous pass cover boards and a spine insert are combined in a correctly fitting manner with the glue-coated covering material in a roll-on device. In successive work stations the projecting edges of the cover, either while in motion or while stationary, are folded, generally first at the edges projecting from the top and bottom and then, after drawing-in of the corners, at the sides. The book covers are then conveyed between press rollers of a pressing apparatus, in which separate systems rub the board covers and the spine insert onto the covering material. In a delivery station the book covers pass in the form of stacks over a roller table for manual removal.

The cover boards are stocked on a prestacking belt, from which they pass in streams or in stacks into a board feed hopper. The lowermost cover boards are pushed out of the feed hopper and supplied together with the spine insert on guide rails in a laterally aligned manner to the rolling-on device. As a spine insert, flexible roll screening cut to length and width in the machine or a cardboard strip previously cut to size may be used, which is introduced into the feed plane of the cover boards immediately prior to the rolling-on operation. In synchronism with the board feed, the covering material is brought by a covering material cylinder into the rolling-on plane. The covering material is decollated from a covering material feed hopper, optionally aligned and supplied by further conveying devices to the covering material cylinder, which takes over the covering material with grippers and conveys it past a glue spreading roller prior to the rolling-on operation.

In the previously known apparatuses the essential functions, such as the board feed, covering material feed, covering material cylinder and folding and pressing apparatus, are coupled directly to one another by a common drive. The functions of decollating the covering material and decollating the cover boards are switchable on and off. Feeding of the spine insert processed from the screening roll is effected by an individual drive controlled in a clocked manner. Further individual drives are assigned to peripheral functions, such as restocking the board feed hopper, stacking and delivering the finished book covers etc. As a result of the direct coupling of the drives of the main functions the entire book cover machine is stopped as soon as a fault arises in the region of the board feed or the covering material feed, and the book cover machine is not re-started until after the fault has been eliminated. Because of the long waiting period, book covers which are situated during said period in the folding apparatus are not durably glued together and have to be discarded as rejects. The result is a lower effective output.

In the known book cover machines the book covers are joined and moved forward in such a way that the leading edges of the boards and book covers are oriented by fixed reference edges, which is also known as conveying with a constant leading edge. The board feed pushes the cover boards and the spine insert towards the rolling-on device by acting on their trailing edge. The stroke position of said board pusher therefore has to be adapted to the book cover format by suitable adjustments, with the result that the board feed is complex and there is only a limited possibility of carrying out a necessary correction during operation. The folding width at the top and bottom of the cover is dependent upon the length difference between the covering material height and the cover board height and/or in some cases also upon the printing format of the covering material. Setting-up of the folding width as well as correction during operation are effected by means of an elaborate differential drive, which is connected in the drive train upstream of the covering material cylinder and the covering material feed and by means of which the covering material is supplied by its leading edge at an earlier and/or later time to the rolling-on device. The setting-up of a new book cover format is time-consuming and therefore reduces the effective output of the machine.

SUMMARY OF THE INVENTION

The object of the invention is to improve an apparatus for manufacturing book covers of the described type in such a way that the effective output of the apparatus is substantially improved.

The object is achieved in a surprisingly simple and economical manner in the subject apparatus, where at least the covering material feed, the board feed and the folding and pressing apparatus are drivable in each case independently of one another.

In the event of a fault in the board feed or in the covering material feed, only the further feed of boards and covering material is stopped, while assembled book covers are completed in the folding and pressing apparatus and fed to the delivery apparatus. Said book covers are securely glued together and need not be discarded as rejects. If the fault e.g. in the board feed has been eliminated by removing the boards of one or more cycles, it is possible by discontinuing the feed of covering material to defer the cycle of the covering material feed automatically by one or more cycles. Secondary faults as a result of feeding covering material without associated boards are avoided. The servo drives may be operated with an adjustable driving torque, with the result that overload functions may be realized in the drive apparatus.

The cycle of the covering material feed and the covering material cylinder relative to the folding and pressing apparatus may be automatically calculated on the basis of the format of the book covers to be manufactured and the covering material height and started. Equally, the stroke position of the board feed, by means of which the boards are pushed at their trailing edge and delivered by their leading edge in clocked synchronism, relative to the joining point of the book covers may be calculated on the basis of the board height and automatically approached by means of the servo drive when the maximum stroke of the board pusher comprises the actual working stroke and the adjustment travel. Previously required differential drives and/or adjusting means may be omitted. A correction of the format adjustments and hence a correction of the position of the assembled book cover elements is possible during operation. The covering material feed may be set up and operated independently of the other devices of the machine.

Traction means such as toothed belts or chains, for reasons to do with their manufacture, do not have a precise pitch. When covering material is fed forward by such means over a plurality of cycles, the individual pieces of covering material are supplied with a varying leading edge to the covering material cylinder. By virtue of the covering material cylinder, which is controlled by an individual servo drive and at times rotates forwards and/or backwards relative to the angle of the folding and pressing apparatus, the covering material is taken over in accordance with the detected leading edge from the covering material feed and at a later stage of transport is conveyed in such a controlled manner that the covering material is rolled with the exact leading edge position onto the boards.

BRIEF DESCRIPTION OF THE DRAWINGS

There now follows a detailed description of an embodiment of the invention, which is illustrated in the drawings. The drawings show.

DETAILED DESCRIPTION OF THE PREFERRED EMBODIMENT

Figure 1:
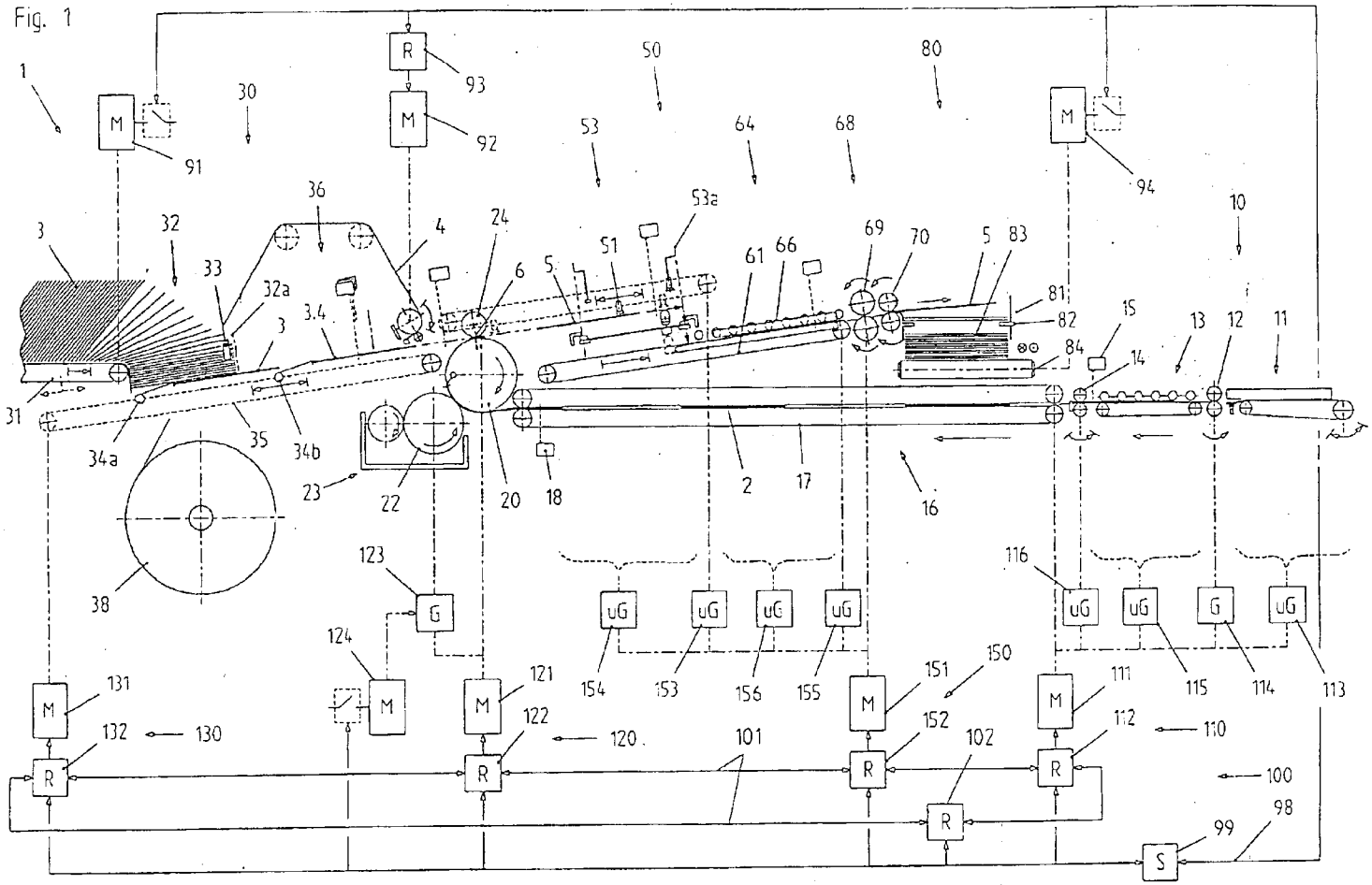
FIG. 1 is a kinematic drive diagram of a book cover machine with functional units illustrated in a simplified side view.
Figure 2:
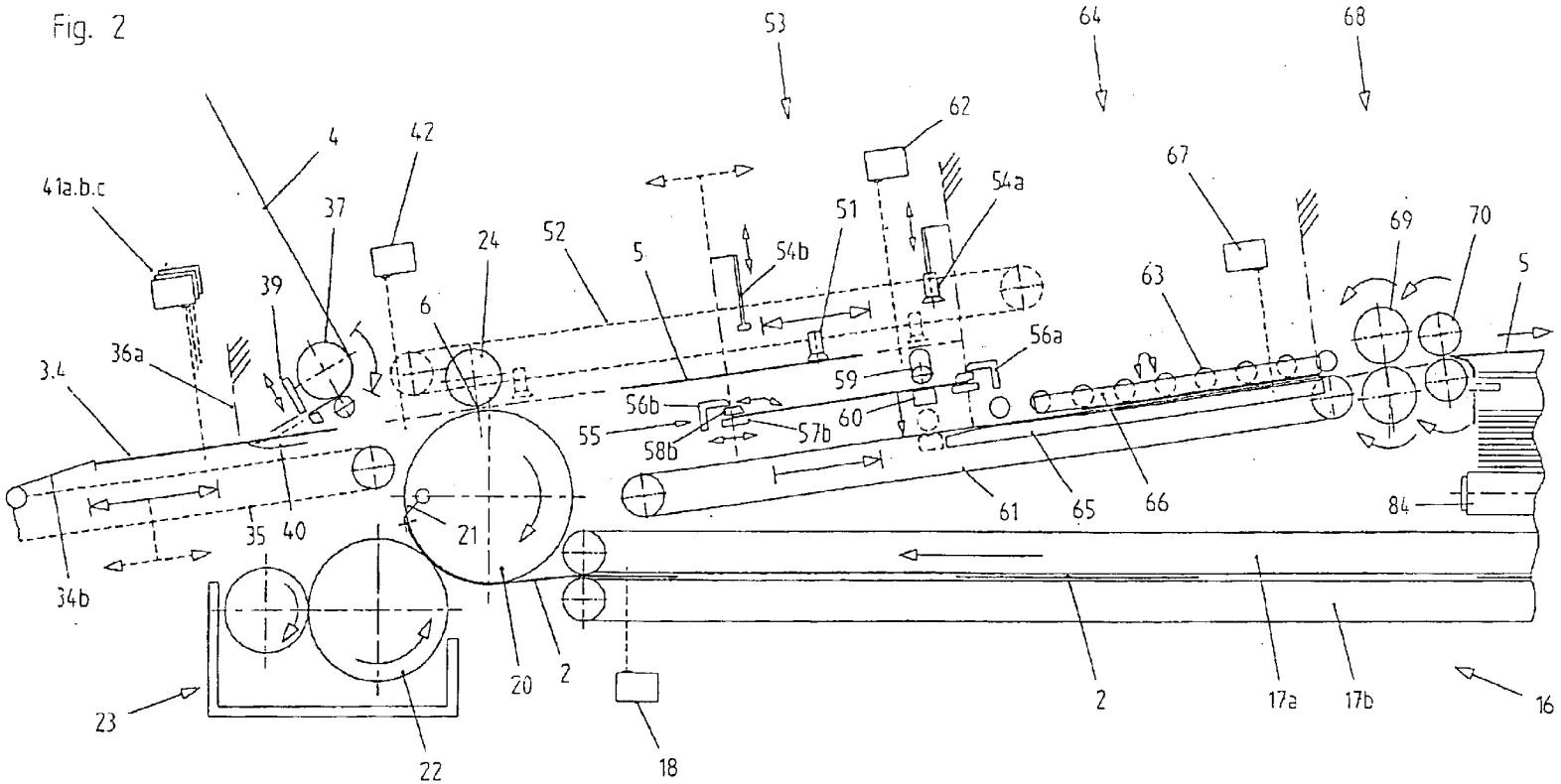
FIG. 2 is an enlarged detail of the book cover machine.

The drawings show in a diagrammatically simplified view a book cover machine 1, in which book covers 5 are manufactured by combining glue-coated covering material 2 with cover boards 3 and spine inserts 4. The covering material 2 is transferred by a covering material feed 10 to a continuously rotating covering material cylinder 20, by means of which the covering material 2 is taken over by grippers 21, conveyed past a glue spreading roller 22 of a gluing mechanism 23 and released at the rolling-on point 6. Synchronously with the respective piece of covering material 2 a left and a right cover board 3 as well as a spine insert 4 are supplied by a board feed 30 to the rolling-on point 6. At the rolling-on point 6 pressure rollers 24, which act separately upon the cover boards 3 and the spine insert 4, ensure that the covering material 2 is rolled in a bubble-free manner onto the boards 3, 4.

The covering material feed 10 comprises an, as such, known covering material feed hopper 11, by means of which in each case the lowermost piece of covering material 2 is separated from a stack, pushed out in a forward direction and supplied to take-off rollers 12, by means of which the covering material 2 under the stack is drawn away and transferred to a likewise known aligning apparatus 13. The covering material 2, which is aligned at the leading edge and at one side in the stationary state in the aligning apparatus 13, is accelerated by acceleration rollers 14 up to the continuous conveying speed of a covering material conveying apparatus 16, which conveys the covering material 2 for a plurality of cycles, and then transferred to said apparatus. A light barrier 15 detects the arrival and departure of the covering material 2 in the aligning apparatus 13. The covering material conveying apparatus 16 comprises a plurality of conveyor belt pairs 17 placed at a distance from one another, wherein a top toothed belt 17*a* presses the covering material 2 onto an elastic support (not shown here) of a bottom toothed belt 17*b*. Disposed at the end of the conveying path is a light barrier 18, which detects the position of the covering material leading edge and supplies the detected position to a control device, which is described later.

Associated with the board feed 30 is a prestacking belt 31, which is provided with a separate drive 91 and which receives the cover boards 3 in an almost upright position and feeds them in a stream to a board feed hopper 32 in that the drive 91 is operated by means of a central control unit 99, which converts the corresponding signals of a light barrier 33. The board feed hopper 32 has a format-defined reference edge 32*a*, against which the cover boards 3 are applied by their leading edge. For different format heights the prestacking belt 31 is positioned accordingly.

The cover boards 3 are pushed by a first board pusher 34*a* out of the board feed hopper 32 and transferred with a constant stroke into an intermediate position 36 with a format-defined reference edge 36*a*. In said intermediate position 36 there is inserted between the two cover boards 3 a spine insert 4 in the form of flexible endless screenings, a suitable length of which is withdrawn from a screening roll 38 by a take-off roller system 37. Via a guide 40 in the form of a flap the spine insert 4 passes into the conveying plane of the cover boards 3 and is cut to length by a cutting device 39. The take-off roller system 37 is operated by a drive 92, which is provided with a stepping motor and with which a control device 93 is associated, which ensures that the required length of the spine insert 4 is withdrawn in clocked synchronism from the screenings roll 38. The time window, within which the withdrawal has to be effected during a work cycle, is communicated to the control device 93 by the central control unit 99 via electric signal lines 98.

The cover boards 3 and the spine insert 4 are then pushed by a second board pusher 34*b*, which executes the same stroke as the first board pusher 34*a*, to the rolling-on point 6 and in the process are aligned in an outward direction in corresponding feed edges. The board pushers 34*a,b* are fastened to a toothed belt 35, the maximum stroke of which comprises both the constant working stroke and the adjustment travel required for the different board heights. For other board formats, through relative rotation of the toothed belt drive only the stroke position is displaced, and the board pusher unit as a whole need not be adjusted. Light barriers 41*a, b, c* detect the pushing-in and pushing-out of the boards 3, 4 in the intermediate position 36, a further light barrier 42 monitors the conveying of the spine insert 4.

At the rolling-on point 6 the boards 3, 4, which are pushed forward at a speed synchronous with the covering material 2, are rolled by the pressure rollers 24 onto the glue-coated covering material 2 and, while still being pushed forward by the second board pusher 34*b*, are grasped by a reciprocating suction crosspiece 51, which is controlled via a toothed belt 52 and moved forward likewise in synchronism during the rolling-on operation, of the folding and pressing apparatus 50 and conveyed with a stroke, which is constant 30 for each format, into a top/bottom folding station 53 with a format-defined reference edge 53*a*, up to which the leading edge of the book cover 5 is conveyed.

In the top/bottom folding station 53 the book cover 5 in a first step is taken over by suction press rams 54*a, b* and pressed by the latter onto folding tables 57*a, b* of a lower-lying top/bottom folding position 55, wherein the projecting edges of the covering material 2 in the course of the transfer motion right themselves against righting edges 56*a, b*. In a second step the righted edges are folded by folders 58*a, b* round the board edges and pressed firmly onto the insides of the boards. During said process, the corners are drawn in by means which are not shown here. In the last step the book cover is grasped by a jamming roller 59 and a jamming pad 60 and, after the folders 58*a, b* and the folding tables 57*a, b* have been retracted, deposited onto a conveyor belt 61 below the top/bottom folding position 55. Said jamming roller presses the book cover 5 onto the conveyor belt 61, while the jamming pad 60 releases the book cover 5. With a stroke, which is constant for all formats, the book cover 5 is then conveyed from the top/bottom folding station 53 into a side folding station 64, wherein pressure rollers 63 disposed along the conveying path press the book cover 5 onto the conveyor belt 61. A light barrier 62 monitors the arrival and transfer of book covers 5 in the upper position of the top/bottom folding station 53.

On its way into the side folding station 64 the book cover 5 runs with its sides over folding tables 65, which are situated to the left and right of the conveyor belt 61 and which right the edges of the covering material 2 which are still projecting from the sides of the book cover 5. Having arrived in the side folding station, the book cover 5 is first fixed on the folding tables 65 by holding-down devices, which are not shown here. The righted edges are then folded by folders 66 round the side board edges and pressed firmly onto the insides of the boards. Once the folders 66 and the holding-down devices have released the book cover 5, the conveyor belt 61 feeds the completely folded book cover 5 to a pressing station 68, in which pressure rollers 69 firmly apply the cover boards 3 and pressure rollers 70 adapted to the width of the spine insert 4 firmly apply the spine insert 4 of the book cover 5. A light barrier 62 monitors the inward and outward conveying of the book covers 5 in the side folding station 64.

In the delivery apparatus 80 the finished book covers 5 are initially placed one on top of the other in partial stacks in an upper stacking plane 81 and deposited through suitable operation of stacking rakes 82 onto the actual book cover stack 83, which on reaching the desired stack quantity is transferred by a delivery belt 84 transversely out of the book cover machine 1 onto suitable storage conveyors, from which removal may be effected by hand or by palletizing robots. The delivery belt 84 is operated by a drive 94, which is provided with a motor and is connected by the central control unit 99 for the outward conveying of book cover stacks 83.

The book cover machine 1 is provided with a drive apparatus 100, which substantially comprises four independent drives 110, 120, 130, 150, which are respectively assigned to the functional units of covering material feed 10, covering material cylinder 20, board feed 30 and folding and pressing apparatus 50 and provided with servomotors 111, 121, 131, 151 and associated control devices 112, 122, 132, 152.

Further uniform- and non-uniform-motion transmissions 113, 114, 115, 116 are associated with the drive 110 of the covering material feed 10, wherein the transmission 113 shown in the drawings represents a plurality of transmissions, by means of which functions of the covering material feed hopper 11 are operated. Equally, the transmission 115 comprehends the transmissions needed to operate the functions in the aligning apparatus 13. The drive 120 is directly connected to the covering material cylinder 20 and via a transmission 123 also drives the gluing mechanism 23, which is additionally connected to a constantly driving auxiliary drive 124 and therefore rotates even when the drive 120 stops the covering material cylinder 20. In the board feed the toothed belt 35, which moves the board pushers 34*a, b* forwards and backwards, is driven by the drive 130. In the aligning and pressing apparatus 50 the individual functions and/or stations are operated via transmissions 153, 154, 155, 156, which are associated with the drive 150. The transmission 154 symbolizes a group of transmissions, which are needed to operate the functions in the top/bottom folding station, while the transmission 156 comprehends the transmissions for the side folding station.

The control devices 112, 122, 132, 152 are connected to one another by a central servo-control 102 via electric signal lines 101 and are designed in such a way that the central servo-control 102 forms a so-called virtual master 102 and the servomotors 111, 121, 131, 151 form the so-called slaves. The virtual master 102 issues control commands and the drives 110, 120, 130, 150 follow in angular synchronism. By virtue of the subdivision of the drive apparatus 100 into the individual drives 110, 120, 130, 150 product-protecting fault handling is possible. Should a fault arise in the covering material feed 10 and be signalled e.g. by the light barrier 15, the covering material feed 10 and the board feed 30 are stopped by the higher-level central control unit 99, while the folding and pressing apparatus 50 and optionally the covering material cylinder 20 continue to be operated until all of the book covers 5 assembled at the time of the fault have left the pressing station 68. The same applies in the event of faults in the board feed 30, which are signalled by the light barriers 41*a, b, c* and 42.

By virtue of the individual drives 110, 120, 130 format adjustments may be effected electronically. For other board heights, the stroke position of the board pushers 34*a, b* is automatically calculated upon entry of the format sizes into the central control unit 99 and adjusted through rotation of the drive 130. The calculated folding width is set through rotation of the drives 110, 120. The variables may moreover be corrected also while the book cover machine 1 is running. An overload function is preferably integrated in the servo drives 111, 121, 131, 151 in that the drives are protected by adjustable current limiting.

The individual servo drive 121 for the covering material cylinder 20 makes it possible for covering material 2, which is supplied by the toothed belt 17*a, b* of the covering material conveying apparatus 16 to the covering material cylinder 20 with its leading edge out of step, to be taken over in accordance with the supplied position and rolled in the exact position onto the boards 3, 4 at the rolling-on point 6. The supplied position is detected by the light barrier 18 and the drive 120, prior to the take-over, rotates the covering material cylinder 20 in accordance with the calculated positional deviation forwards or backwards relative to the virtual master 102 in order to bring the covering material 2 after the take-over into the exact position by means of an accompanying counter movement.

What is claimed is:

1. Apparatus for manufacturing book covers from supplies of covering material, cover boards and spine inserts, the cover boards having edges including trailing and leading edges, the book cover having a height and a folding width, the apparatus comprising:

a board feed adapted for supplying cover boards and spine inserts from the supplies of cover boards and board inserts, respectively;

a covering material feed adapted for supplying covering material from the supply of covering material;

a glue spreading roller;

a covering material cylinder adapted for conveying the covering material past the glue spreading roller and assembling a book cover from the covering material, cover boards and spine inserts;

a folding and pressing apparatus for folding covering material projecting beyond the edges of the cover board around the edges of the cover board and pressing the book cover;

a delivery apparatus for delivering the book covers in stacks; and a drive apparatus driving the covering material feed, the board feed, the covering material cylinder, and the folding and pressing apparatus, at least the covering material feed, the board feed and the folding and pressing apparatus being independently drivable from one another.

2. Apparatus according to claim 1 further comprising a positioning control and wherein the drive apparatus includes an independent drive for each of the covering material feed, the board feed and the folding and pressing apparatus, the positioning control tuning the independent drives of the covering material feed, the board feed and the folding and pressing apparatus to one another during operation and after stoppages.

3. Apparatus according to claim 2 wherein the covering material cylinder is directly simultaneously drivable by another of the independent drives.

4. Apparatus according to claim 1 wherein the drive apparatus includes an independent drive associated with the covering material cylinder.

5. Apparatus according to claim 2 wherein the covering material cylinder is directly connectable to another of the independent drives.

6. Apparatus according to claim 2 wherein all of the independent drives are servo drives.

7. Apparatus according to claim 2 wherein all of the independent drives are operable in clocked synchronism.

8. Apparatus according to claim 2 wherein all of the independent drives are operable in angular synchronism.

9. Apparatus according to claim 6 wherein one of the servo drives is operated as a master and the other servo drives are operated in each case as a slave.

10. Apparatus according to claim 9, characterized in that the independent drive of the folding and pressing apparatus is the master and the other independent drives are in each case a slave.

11. Apparatus according to claim 6 further comprising a central control unit defining a virtual master, each of the independent drives being a slave.

12. Apparatus according to claim 6 wherein the board feed reciprocates over a stroke from an input position, where the board feed engages the trailing edge of the cover board, to a discharge position, where the cover board is delivered by the leading edge, the position of the board feed in the stroke being adjustable relative to the height of the book cover by means of the servo drive.

13. Apparatus according to claim 1 wherein the covering material feed and the covering material cylinder are electronically adjustable relative to the folding width of the book cover.

14. Apparatus according to claim 1 further comprising covering material detector means for detecting the position of the leading edge of the covering material and wherein the drive apparatus includes a cylinder drive for the covering material cylinder, the covering material detector means sending a signal to the cylinder drive for aligning the covering material cylinder, whereby the covering material is combined in the correct position with the boards.

15. Apparatus according to claim 6 wherein the servo drives have overload functions.

16. Apparatus for manufacturing book covers from supplies of covering material, cover boards and spine inserts, the cover boards having edges including trailing and leading edges, the book cover having a height and a folding width, the apparatus comprising:

a board feed adapted for supplying cover boards and spine inserts from the supplies of cover boards and board inserts, respectively;

a covering material feed adapted for supplying covering material from the supply of covering material;

a glue spreading roller;

a covering material cylinder adapted for conveying the covering material past the glue spreading roller and assembling a book cover from the covering material, cover boards and spine inserts;

a folding and pressing apparatus for folding covering material projecting beyond the edges of the cover board around the edges of the cover board and pressing the book cover;

a delivery apparatus for delivering the book covers in stacks;

a drive apparatus driving the covering material feed, the board feed, the covering material cylinder, and the folding and pressing apparatus, the drive apparatus including an independent drive for each of the covering material feed, the board feed and the folding and pressing apparatus; and a positioning control for tuning the independent drives of the covering material feed, the board feed and the folding and pressing apparatus to one another during operation and after stoppages.

* * * * *